United States Patent [19]

Hardigg et al.

[11] Patent Number: 5,012,553

[45] Date of Patent: May 7, 1991

[54] LIGHTWEIGHT HANDLE

[75] Inventors: James S. Hardigg, South Deerfield; Stanley W. Lewandowski, Jr., Buckland, both of Mass.

[73] Assignee: Hardigg Industries, Inc., South Deerfield, Mass.

[21] Appl. No.: 378,266

[22] Filed: Jul. 11, 1989

[51] Int. Cl.[5] ..... A47B 95/02

[52] U.S. Cl. ..... 16/126; 16/127; 220/94 R

[58] Field of Search ..... 16/119, 126, 127, 307, 16/308, 75, 76, 375; 220/94 R

[56] References Cited

U.S. PATENT DOCUMENTS

| | | | |
|---|---|---|---|
| 337,889 | 3/1886 | Taylor | 16/126 |
| 747,570 | 12/1903 | Pickop | 16/375 |
| 908,285 | 12/1908 | Lewis | 16/119 |
| 1,940,099 | 12/1933 | Preston | 16/307 |
| 2,254,506 | 9/1941 | Wheary, Jr. | 16/126 |
| 2,517,369 | 8/1950 | Wolfram | 16/126 |
| 3,538,538 | 11/1970 | Field | 16/307 |
| 3,562,849 | 2/1971 | Brayshaw | 16/126 |
| 3,804,290 | 4/1974 | Billman | 220/94 R |
| 3,813,729 | 6/1974 | Szalo et al. | 16/126 |
| 4,475,415 | 10/1984 | Yamamoto | 16/374 |

*Primary Examiner*—Kurt Rowan
*Assistant Examiner*—James Miner
*Attorney, Agent, or Firm*—Fishman, Dionne & Cantor

[57] ABSTRACT

A lightweight handle for lifting and transporting a heavy-duty container. The handle of the present invention includes a spring return mechanism for automatically storing the shank of the handle when not in use. A further feature of the present invention includes a stop mechanism for limiting the pivotal movement of the handle shank to approximately 90 degrees.

30 Claims, 4 Drawing Sheets

LIGHTWEIGHT HANDLE

FIELD OF THE INVENTION

The present invention relates to a lightweight handle for lifting and transporting heavy-duty containers.

BACKGROUND OF THE INVENTION

The use of handles for lifting and transporting various objects are well known. For certain applications, it is desirable to use a handle that is light in weight, yet durable and capable of lifting heavy objects. This is particularly true in the case of roto-molded plastic containers which are designed for the transport of sensitive electronic equipment under stringent weight restrictions imposed by military specifications. Similarly, these containers are used for commercial applications where shipping weight is an important economic consideration.

Typically, a shipping container must be of a heavy-duty construction. Consequently, any weight savings achieved through the handle design can be exploited by using more container-forming material to construct a stronger, more durable container that is better able to house its contents, such as electronic equipment. In addition to roto-molded plastic, other materials, such as aluminum, steel, or fiberglass can be used to form the container.

It is also important in using containers for such applications that the handle be capable of lifting the container with relative ease and also be capable of automatically storing itself out of the way when not in use. Self-storage of the handle avoids possible deformation of the container caused by concentrated loads transmitted through the handle. This design feature also avoids the possibility of damage to the handle itself.

DESCRIPTION OF THE PRIOR ART

Numerous prior art references disclose return mechanisms for storing a handle out of the way when not in use. One such device is shown in U.S. Pat. No. 2,767,424, issued Oct. 23, 1956, to Knuepfer. That device, however, employs a typical spring and bale arrangement to bias the handle into an inoperative position, which contributes significantly to the weight of the handle.

Another handle design is disclosed in U.S. Pat. No. 2,254,506, issued Sept. 2, 1941, to Wheary, Jr. The return mechanism in that reference employs coiled springs completely enclosed within the hollow interior of each handle support. The restricted access to the handle return mechanism, however, complicates assembling and repairing the unit. Further, the handle support of the Wheary, Jr. device must be made larger to house the return mechanism which adds to the overall weight of the handle.

The handle disclosed in U.S. Pat. No. 3,562,849, issued Feb. 16, 1971, to Brayshaw, suffers from the same design limitations as the Wheary, Jr. device.

One manner of improving the ease of transporting containers is to employ a handle having stops that limit its pivotal movement. Prior art examples include U.S. Pat. No. 3,804,290, issued Apr. 16, 1974, to Billman and U.S. Pat. No. 644,119, issued Feb. 27, 1900, to Witt. However, neither of those prior art references discloses a stop mechanism designed to minimize the weight of the handle.

SUMMARY OF THE INVENTION

An object of the present invention is to provide a lightweight handle capable of lifting and transporting heavy-duty containers in a simple, easy manner. A further object of the present invention is to provide a handle that automatically stores itself out of the way when not in use.

To accomplish these objects, the handle of the present invention employs a shank member having a handgrip portion with a pair of pivoting arm members extending therefrom. The shank member pivots between a first inoperative position and a second operative position, and is capable of being returned automatically to the first inoperative position. The pivoting arm members each have a distal end pivotally secured between side walls of a pair of respective brackets using a pair of pivot pins. The pivot pins include a cylindrical member and a head member formed on one end of the cylindrical member. The other end of each cylindrical member engages holes in the side walls of respective brackets so that the pivot pins rotate about the pin axis. The cylindrical members also are fixedly engaged within holes in the distal ends of the arm members so that the shank member pivots with respect to the brackets. Stop pins, fixedly supported in a pair of aligned openings in the side walls of the brackets, limit the pivotal movement of the shank member between the first inoperative position and the second operative position to approximately 90 degrees.

A spring, located remotely from the brackets, surrounds the cylindrical member of each pivot pin. The spring has one end that engages the bracket and another end that rotates with a remote end of the pivot pin via a cover piece. With this arrangement, the spring will be twisted as the shank member is pivoted from its first inoperative position into its second operative position and will bias the shank member into its first inoperative position upon release of the shank member from its second operative position.

Other objects, features, and characteristics of the present invention, as well as the methods, operation, and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The instant invention may best be understood with reference to the accompanying drawings wherein.

DETAILED DESCRIPTION OF THE INVENTION

Figure 1:
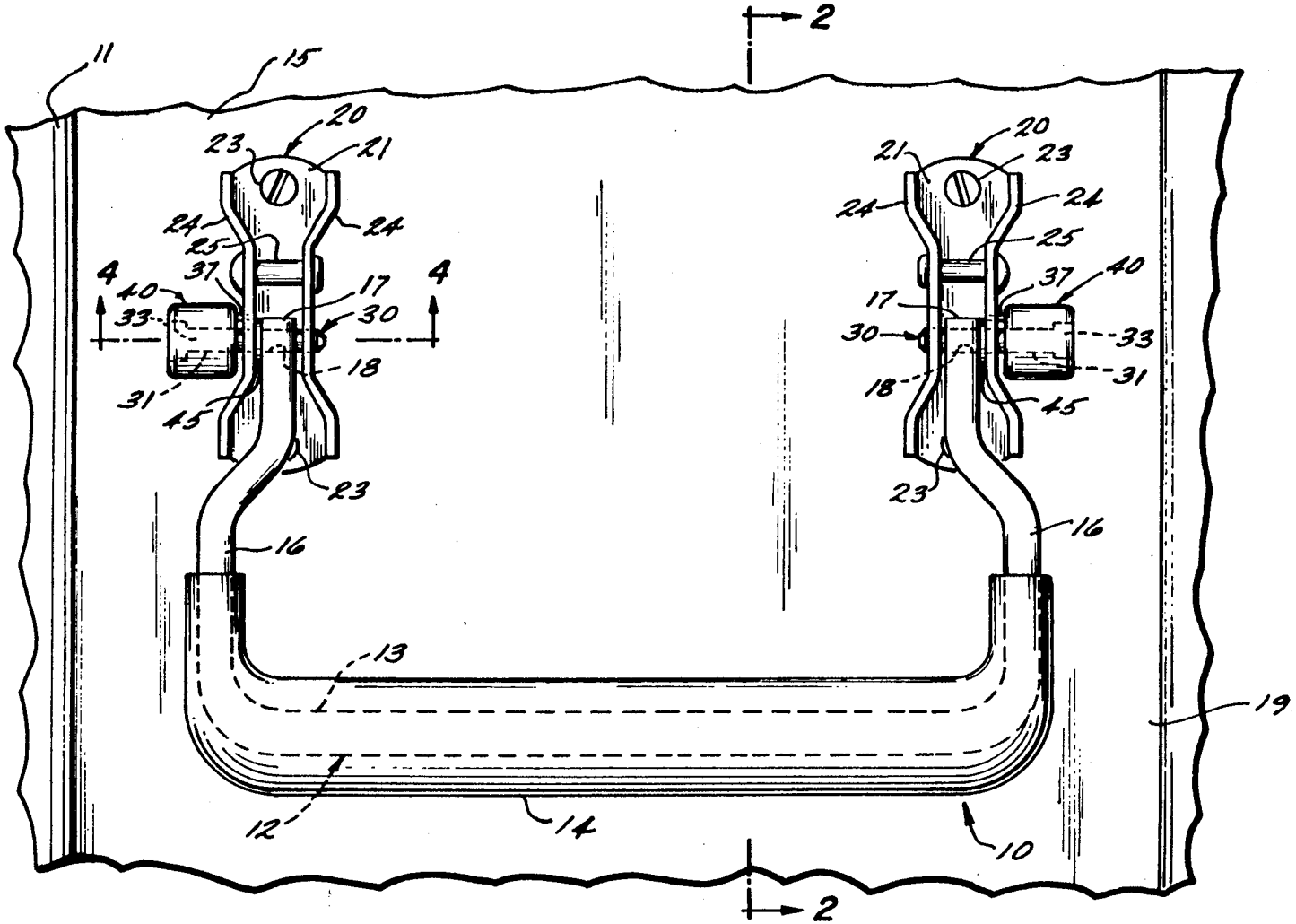
FIG. 1 is a front view of the lightweight handle according to the present invention secured to the side of a container.

FIG. 1 illustrates a lightweight handle 10 according to the present invention for lifting and transporting a heavy-duty, roto-molded plastic container 11. The handle 10 includes a pivoted U-shaped shank member 12. A hand-grip member 13 forms the base portion of the shank member 12, the length of which is sufficient to allow a person's hand to comfortably grasp the handle for lifting and carrying the container 11. A protective cover 14, preferably made of polyethylene, surrounds hand-grip member 13. The cover 14 provides user comfort and protects the container side wall 15, to which handle 10 is attached, from damage by the hand-grip member 13.

Formed integrally with the ends of the hand-grip member 13 are two perpendicularly extending pivoting arm members 16. The distal end 17 of each arm member 16 is pivotally secured to respective bracket support members 20. The arm members 16 pivot about a pivot pin 30 to be described in detail below.

Figure 2:
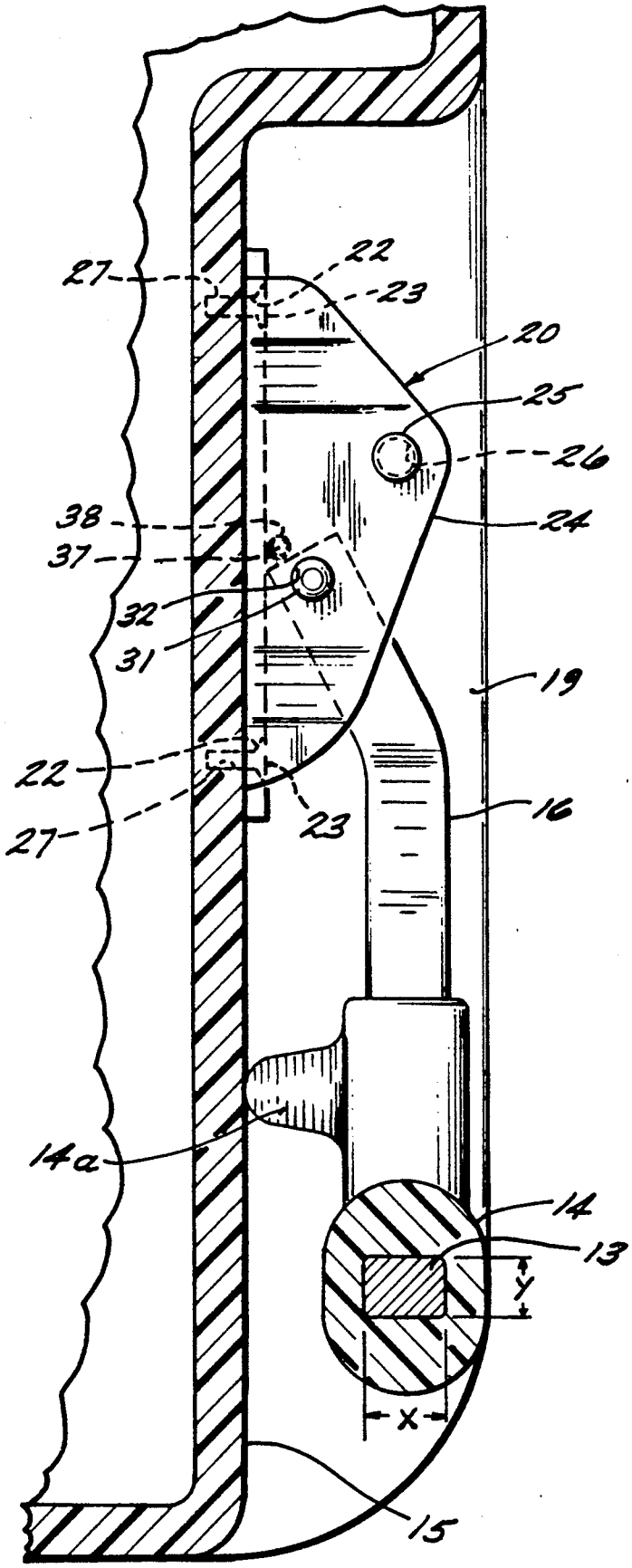
FIG. 2 is a cross-sectional view taken along line 2—2 in FIG. of the lightweight handle according to the present invention in its inoperative position.

Because of the manner in which shank member 12 pivots, the forces exerted on handle 10 in the lateral direction is less than those in the pivotal plane. Thus, as indicated in FIG. 2, the width x of the hand-grip member 13 and pivoting arm members 16 is made slightly larger than the thickness y of those members. The protective cover 14 that surrounds hand-grip member 13 is oval-shaped, having its larger thickness arranged in the vertical direction when the handle 10 is in its inoperative position (FIG. 2) so that it is easier to grasp. A slightly raised portion 14*a* formed on cover 14 keeps it spaced from the side wall 15 of container 11 and facilitates lifting the handle 10 from its stowed position.

The bracket support members 20 have an elongated base plate 21 in which two holes 22 are formed at either end. The handle 10 is attached within a handle well 19 of the side wall 15 of container 11 using screws, bolts, rivets, or other suitable securing means 23, which pass through the holes 22 formed in the base plate 21 and the holes 27 formed in the container wall 15. In practice, two handles 10 are typically used on either side of container 11 for lifting and transporting the container 11. Of course, container 11 could also be lifted by a single handle 10 mounted to the top of the container 11, or by other arrangements that would be apparent to one of ordinary skill in the art.

Figure 3:
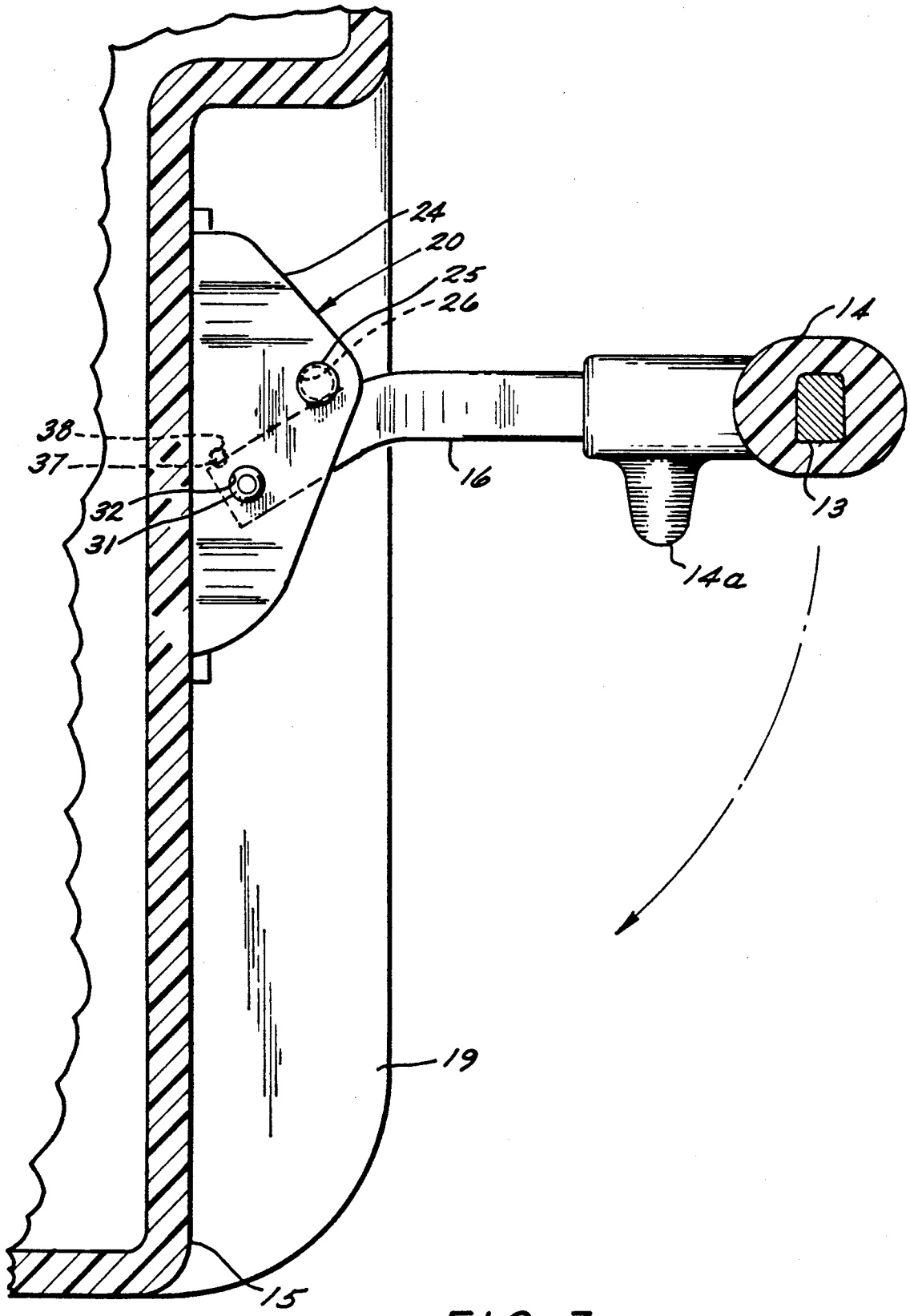
FIG. 3 is same cross-sectional view of the lightweight handle according to the present invention shown in FIG. 2, but shown in its operative position.

As best seen in FIGS. 2 and 3, each bracket support member 20 is also formed with a pair of side walls 24 that are formed integrally with the sides of the base plate 21 and extend perpendicularly therefrom. The depth of the handle well 19 is approximately equal to the width of the side walls 24 of the bracket support members 20. In this way, the handle 10 is stored within the recess of well 19 when handle 10 is in its inoperative position (FIG. 2).

The side walls 24 serve as the supporting surface for the pivot pin 30. A stationary stop pin 25 is force-fitted through a pair of aligned openings 26 in each side wall 24 to reinforce their rigidity.

Referring to FIG. 3, the stop pin 25 of each bracket support member 20 also serves as an abutting surface for the pivot arms 16 of the shank member 12. The stop pins 25 are located at the appropriate distance along the side walls 24 so that the pivot motion of the shank member 12 is restricted to a sweep of 90 degrees. In other words, the shank member 12, when lifted during operation, pivots from its essentially vertical, inoperative position, to an essentially horizontal position. Restricting the pivotal movement of the handle helps stabilize the container during transportation so that the contents of the container are less likely to become damaged.

An additional feature of the present invention is the return mechanism that automatically repositions the shank member 12 of handle 10 into its stowed position when released from its operative position. An important feature of the return mechanism is the design of the pivot pin 30.

Figure 4:
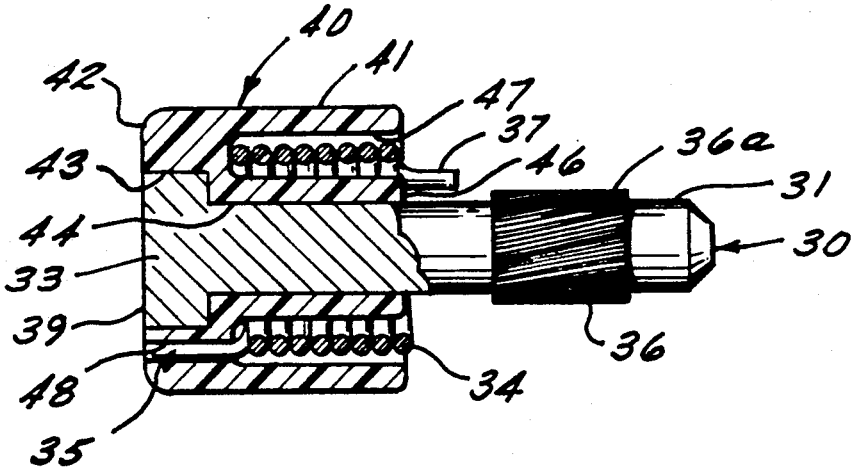
FIG. 4 is a partial cross-sectional view of the handle return mechanism according to the present invention taken along line 4—4 in FIG. 1.

Referring to FIG. 4, pivot pin 30 has an elongated, cylindrical base member 31 which forms the pivot surface for the arm members 16 of the handle 10. As shown in FIGS. 2 and 3, the cylindrical base member 31 of each pin 30 is loosely fitted within a pair of aligned holes 32 formed through the side walls 24 of the bracket support member 20 and is force-fitted within a hole 18 formed through arm member 16 (FIG. 1). To facilitate the pivotal movement of the shank member 12, a low-friction, plastic washer 45 is fitted on pivot pin 30 between each arm member 16 and one of the side walls 24 of each bracket support member 20, as shown in FIG. 1.

Referring back to FIG. 4, a hex-shaped head member 33 is formed on one end of the cylindrical base member 31. A helical torsion spring 34 is provided in surrounding relation to the base member 31 of the pivot pin 30 remotely from the bracket support member 20.

Figure 5:
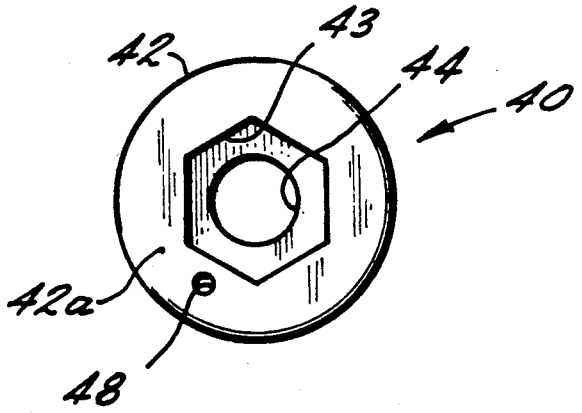
FIG. 5 is an end view of the protective cover piece for the return mechanism of the present invention.

To maintain the spring mechanism in proper working order, a cylindrical protective cover piece 40, preferably made of a polyethylene plastic material, surrounds the pivot pin 30 to prevent foreign material or other objects from interfering with the torsion spring 34. As shown in FIGS. 4 and 5, cover piece 40 comprises a cylindrical body portion 41 and circular end cap 42 formed integrally therewith. A depression 43 is formed in the end cap 42 of cover piece 40 corresponding to the hex shape of the head member 33 of pivot pin 30. The depth of depression 43 corresponds to the thickness of head member 33 so that when pin 30 is placed through a hole 44 in end cap 42, the top surface 39 of head member 33 will be flush with the outer surface 42*a* of the end cap 42.

Cover piece 40 is further provided with a cylindrical guide member 46, which extends through the middle of, and along the length of, the cylindrical body portion 41. The guide member 46 has an inner diameter that corresponds approximately to that of the cylindrical base member 31 so that base member 31 fits within guide member 46 and rotates therewith. The guide member 46, together with the cylindrical body portion 41 of cover piece 40, also form an outer annulus 47 for housing the torsion spring 34.

In addition to the depression 43, end cap 42 is formed with a hole 48 therethrough. One end 35 of helical torsion spring 34, closest to the head member 33 of pivot pin 30, is bent at an angle so that it can be engaged with the hole 48 formed in the end cap 42. The other end 37 of spring 34 is bent at an angle and is held stationary by engaging with an opening 38 in one of the side walls 24 of support member 20.

It will further be noted that the cylindrical base member 31 of each pivot pin 30 has a slightly raised portion 36 in which helical grooves 36*a* are formed. The outside diameter of said raised portion 36 is slightly less than the diameter of said holes 32 in the side walls 24 of the bracket support member 20. When the cylindrical base members 31 are force-fitted through the holes 18 in the arm members 16, the helical grooves 36*a* cause the pins 30 to rotate. The length of spring end 37 is long enough to engage with opening 38 in side wall 24 as raised portion 36 begins its force-fit engagement with holes 18. The helical grooves 36*a* are angled such that the axial travel of the cylindrical base members 31 as they are being force fit will cause the pin 30, along with the free end 35 of spring 34, to rotate approximately 60 degrees. The rotation of the pin 30 sufficiently pre-loads the spring 34 so that shank member 12 will be biased firmly against the side of container 11 when mounted thereto. That position avoids possible damage to the handle that might otherwise occur if it were loosely held.

In this arrangement, it will be seen that when the shank member 12 of handle 10 is pivoted into its operative position, as shown in FIG. 3, each pivot pin 30 will rotate with its corresponding pivot arm 16. The head member 33 of pin 30, in turn, rotates with the end cap 42 and, thereby, rotates the free end 35 of torsion spring 34, thus further loading the spring 34. Upon release of shank member 12, the spring 34 unwinds itself and exerts a force through the spring end 35 and cover piece 40 to the head member 33 of pivot pin 30. That, in turn, imparts a torque to the base member 31 of pin 30, which is transmitted to the arm members 16 of handle shank 12, returning it to its stowed position against the side wall 15 of container 11 (FIG. 2). Storing the shank member 12 when the handle 10 is not in use protects it against damage that might otherwise occur in transit.

The design of the handle 10, which is made preferably from heat-treated stainless steel, is extremely lightweight, yet is strong enough to lift containers weighing over 500 pounds. Compared to handles of similar strength, the handle 10 according to the present invention weighs only one-half as much, i.e., approximately one quarter of a pound.

Although the invention has been described in connection with what is presently considered to be the most practical and preferred embodiment, it is to be understood that the invention is not to be limited to the disclosed embodiment, but, on the contrary, is intended to cover various modifications and equivalent arrangements included within the spirit and scope of the appended claims, which scope is to be accorded the broadest interpretation to encompass all such modifications and equivalent structures.

What is claimed is:

1. A lightweight handle for lifting and transporting a heavy-duty container, comprising:

a shank member having a hand-grip portion and a pair of pivoting arm members extending from said hand-grip portion, said shank member capable of being pivoted between a first inoperative position and a second operative position, and being returned automatically to said first inoperative position;

a pair of bracket support members each comprising an elongated base plate and a pair of sidewalls extending therefrom;

said pivoting arm members each having a respective distal end pivotally secured to said pair of respective bracket support members;

a pair of pivot pin means each having an axis and two ends, each pivot pin means engaging at one end respective bracket support members to that said pivot pin means rotates about said pin axis, said one end of each pivot pin means fixedly engaged with respective distal ends of said arm members so that said shank member can pivot with respect to said bracket support members, and said other end of said pivot pin means located remotely from said bracket support members; and, spring means having two distal ends, one of said distal ends of said spring means engaging said bracket support members, the other of said distal ends of said spring means rotatable with said pivot means at said remote end, whereby said spring means will be wound up as said shank member is pivoted from said first inoperative position into said second operative position and, upon release of said shank member from said second operative position, said spring means will bias said shank member into said first inoperative position.

2. A lightweight handle as set forth in claim 1, wherein each pivot pin means has a cylindrical base member and a head member secured to one end of said cylindrical base member corresponding to said remote end of said pivot pin means.

3. A lightweight handle as set forth in claim 2, wherein each cylindrical base member of said pivot pin means is loosely fitted within a first pair of aligned openings in said side walls of respective bracket support members so that said pivot pin means can rotate about said pivot pin axis.

4. A lightweight handle as set forth in claim 3, wherein each cylindrical base member of said pivot pin means is force-fitted within respective openings formed in said distal ends of said pivoting arm members, and each pivoting arm member is located between said side walls of respective bracket support members.

5. A lightweight handle as set forth in claim 4, wherein each cylindrical base member of said pivot pin means has a slightly raised portion, said raised portion formed with a plurality of helical grooves for engaging said opening formed in said pivoting arm members.

6. A lightweight handle as set forth in claim 2, wherein said spring means is in surrounding relation to said base member of each pivot pin means, and one distal end of said compression spring means engages one of said side walls of said bracket support members.

7. A lightweight handle as set forth in claim 6, further comprising a cover piece for protecting said spring means from interference with foreign matter or other objects.

8. A lightweight handle as set forth in claim 7, wherein said cover piece is formed with a cylindrical body portion and an end cap member formed at an open end of said body portion, said end cap member having a depression formed therein for engaging said head member of said pivot pin.

9. A lightweight handle as set forth in claim 8, wherein said cover piece is further formed with a cylindrical guide member extending through the interior of said cover piece, said guide member having an inner diameter corresponding approximately to that of said cylindrical base member of said pivot pin.

10. A lightweight handle as set forth in claim 9, wherein said guide member, together with said cylindrical body portion of said cover piece, form an annulus, said spring means being arranged within said annulus.

11. A lightweight handle as set forth in claim 8, wherein said end cap member of said cover piece is further formed with a hole therethrough.

12. A lightweight handle as set forth in claim 11, wherein said one distal end of said spring is fitted within a hole in one of said side walls of said bracket support members, and said other distal end of said spring is fitted within said hole in said end cap member.

13. A lightweight handle as set forth in claim 1, wherein a protective cover is provided in surrounding relation to said hand-grip portion of said shank member to protect said shank member and said container from damage when said shank member is returned automatically from said second operative position to said first inoperative position.

14. A lightweight handle as set forth in claim 13, wherein said protective cover is formed with a raised portion to space said hand-grip portion from said container and to facilitate lifting said shank member when in its firs inoperative position.

15. A lightweight handle for lifting and transporting a heavy-duty container, comprising:

a shank member having a hand-grip portion and a pair of pivoting arm members extending from said hand-grip portion, said shank member capable of being pivoted between a first inoperative position and a second operative position;

a pair of bracket support members each comprising an elongated base plate and a pair of side walls extending therefrom;

said pivoting arm members each having a respective distal end pivotally secured to said pair of respective bracket support members;

a pair of pivot pin means having an axis and engaging respective bracket support members so that said pivot pin means rotate about said pin axis, each pivot pin means fixedly engaging one of said distal ends of said arm members so that said shank member can pivot with respect to said bracket support members; and stop means provided on said bracket support members for engaging said arm members and limiting said pivot movement of said shank member between said first inoperative position and said second operative position to approximately 90 degrees, said stop means comprising a stop pin fixedly supported in a pair of aligned openings in said sidewalls of each bracket support member.

16. A lightweight handle for lifting and transporting a heavy-duty container, comprising:

a shank member having a hand-grip portion and a pair of pivoting arm members extending from said hand-grip portion, said shank member capable of being pivoted between a first inoperative position and a second operative position, and being returned automatically to said first inoperative position;

a pair of bracket support members each comprising an elongated base plate and a pair of side walls extending therefrom;

said pivoting arm members each having a respective distal end pivotally secured to said pair of respective bracket support members;

a pair of pivot pin means having an axis and two ends, each pivot pin means engaging at one end respective bracket support members so that said pivot pin means rotate about said pin axis, said one end of each pivot pin means fixedly engaged with respective distal ends of said handle arm members so that said shank member can pivot with respect to said bracket support members, and said other end of said pivot pin means located remotely from said bracket support members;

spring means having two distal ends, one of said distal ends of said spring means engaging said bracket support members, the other of said distal ends of said spring means rotatable with said pivot means at said remote end, whereby said spring means will be wound as said shank member is pivoted from said first inoperative position into said second operative position and, upon release of said shank member from said second operative position, said spring means will bias said shank member into said first inoperative position; and stop means provided on said bracket support members for engaging said arm members and limiting said pivot movement of said shank member between said first inoperative position and said second operative position to approximately 90 degrees.

17. A lightweight handle as set forth in claim 16, wherein each pivot pin means has a cylindrical base member and a head member secured to one end of said cylindrical base member corresponding to said remote end of said pivot pin means.

18. A lightweight handle as set forth in claim 17, wherein each cylindrical base member of said pivot pin means is loosely fitted within a first paid of aligned openings in said side walls of respective bracket support members so that said pivot pin means can rotate about said pivot pin axis.

19. A lightweight handle as set forth in claim 18, wherein each cylindrical base member of said pivot pin means is force-fitted within respective openings formed in said distal ends of said pivoting arm members, and each pivoting arm member is located between said side walls of respective bracket support members.

20. A lightweight handle as set forth in claim 19, wherein each cylindrical base member of said pivot pin means has a slightly raised portion, said raised portion formed with a plurality of helical grooves for engaging said opening formed in said pivoting arm members.

21. A lightweight handle as set forth in claim 17, wherein said spring means is in surrounding relation to said base member of each pivot pin means, and one distal end of said spring means engages one of said side walls of said bracket support members.

22. A lightweight handle as set forth in claim 21, further comprising a cover piece for protecting said spring means from interference with foreign matter or other objects.

23. A lightweight handle as set forth in claim 22, wherein said cover piece is formed with a cylindrical body portion and an end cap member formed at an open end of said body portion, said end cap member having a depression formed therein for engaging said head member of said pivot pin.

24. A lightweight handle as set forth in claim 23, wherein said cover piece is further formed with a cylindrical guide member extending through the interior of said cover piece, said guide member having an inner diameter corresponding approximately to that of said cylindrical base member of said pivot pin.

25. A lightweight handle as set forth in claim 24, wherein said guide member, together with said cylindrical body portion of said cover piece, form an annulus, said spring means being arranged within said annulus.

26. A lightweight handle as set forth in claim 23, wherein said end cap member of said cover piece is further formed with a hole therethrough.

27. A lightweight handle as set forth in claim 26, wherein said one distal end of said spring is fitted within a hole in one of said side wall of said bracket support members, and said other distal end of said spring is fitted within said hole in said cap member.

28. A lightweight handle as set forth in claim 16, wherein a protective cover is provided in surrounding relation to said hand-grip portion of said shank member to protect said shank member and said container from damage when said shank member is returned automatically from said second operative position to said first inoperative position.

29. A lightweight handle as set forth in claim 28, wherein said protective cover is formed with a raised portion to space said hand-grip portion from said container and to facilitate lifting said shank member when in its first inoperative position.

30. A lightweight handle as set forth in claim 16, wherein said stop means comprising a stop pin fixedly suported in a pair of aligned openings in said side walls of each bracket support members.

* * * * *